US007629867B2

(12) United States Patent
Tsujiguchi et al.

(10) Patent No.: US 7,629,867 B2
(45) Date of Patent: Dec. 8, 2009

(54) FILTER ELEMENT AND METHOD FOR MANUFACTURING THE SAME

(75) Inventors: Tatsuya Tsujiguchi, Ishikawa-gun (JP); Yukihiro Kitaichi, Ishikawa-gun (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/037,180

(22) Filed: Feb. 26, 2008

(65) Prior Publication Data

US 2008/0143458 A1 Jun. 19, 2008

Related U.S. Application Data

(63) Continuation of application No. PCT/JP2007/063989, filed on Jul. 13, 2007.

(30) Foreign Application Priority Data

Aug. 2, 2006 (JP) ..... 2006-211003

(51) Int. Cl.
*H01P 1/205* (2006.01)
*H01P 1/203* (2006.01)

(52) U.S. Cl. ..... 333/203; 333/204; 333/219

(58) Field of Classification Search ..... 333/203–205, 333/219

See application file for complete search history.

(56) References Cited

U.S. PATENT DOCUMENTS

| | | | | |
|---|---|---|---|---|
| 4,371,853 A | | 2/1983 | Makimoto et al. | |
| 5,105,173 A | | 4/1992 | Itou | |
| 5,248,949 A | * | 9/1993 | Eguchi et al. | 333/204 |
| 5,489,881 A | * | 2/1996 | Yuda et al. | 333/203 |
| 5,994,978 A | * | 11/1999 | Vangala | 333/134 |
| 6,265,954 B1 | * | 7/2001 | Krause | 333/204 |

FOREIGN PATENT DOCUMENTS

| | | | |
|---|---|---|---|
| JP | 4-92802 | U | 8/1992 |
| JP | 05-251905 | A | 9/1993 |
| JP | 05-291802 | A | 11/1993 |
| JP | 06-216605 | A | 8/1994 |
| JP | 07-058509 | A | 3/1995 |
| JP | 07-058521 | A | 3/1995 |
| JP | 07-226603 | A | 8/1995 |
| JP | 08-148902 | A | 6/1996 |
| JP | 10-056308 | A | 2/1998 |
| JP | 10-065401 | A | 3/1998 |
| JP | 10-107537 | A | 4/1998 |
| JP | 11-186812 | A | 7/1999 |

OTHER PUBLICATIONS

Official communication issued in the International Application No. PCT/JP2007/063989, mailed on Aug. 21, 2007.

* cited by examiner

*Primary Examiner*—Benny Lee
(74) *Attorney, Agent, or Firm*—Keating & Bennett, LLP

(57) ABSTRACT

A filter element includes a flat dielectric substrate, a ground electrode on a back main surface of the dielectric substrate, resonant lines each having a shorting end in the vicinity of a border between a side of the dielectric substrate and the ground electrode and extending from the side to a front main surface of the dielectric substrate. The resonant lines and the ground electrode constitute strip-line resonators. In any of the strip-line resonators, the line width of the resonant-line side portion is different from the line width of the resonant-line main-surface portion.

11 Claims, 5 Drawing Sheets

FILTER ELEMENT AND METHOD FOR MANUFACTURING THE SAME

BACKGROUND OF THE INVENTION

1. Field of the Invention

The present invention relates to a filter element in which a strip-line resonator is disposed on a dielectric substrate. The present invention also relates to a method for manufacturing a filter element.

2. Description of the Related Art

There are previously known filter elements that have wide-band frequency characteristics utilizing a coupling of a plurality of strip-line resonators.

Japanese Unexamined Patent Application Publication No. 10-65401 discloses a filter element in which a plurality of strip-line resonators disposed on a single dielectric substrate serve as filters. The filter element includes a ground electrode on a back main surface and a side surface of the flat dielectric substrate and also includes resonant lines each having a shorting end in the vicinity of a border between the side surface and a front main surface. The shorting ends of adjacent strip-line resonators are positioned in the same orientation and the open ends thereof are positioned in the same orientation, and the strip-line resonators are comb-line coupled. The degree of strength of comb-line coupling is increased by the provision of a main-surface electrode for comb-line coupling.

Japanese Unexamined Patent Application Publication No. 7-58521 discloses a filter element in which a plurality of groups of strip-line resonators having different resonant frequencies is disposed on a single dielectric substrate. The filter element includes a ground electrode on a back main surface and a portion of a side of the flat dielectric substrate, a first group of resonant lines (strip-line resonators) extending from a ground electrode of the back main surface to the side and the front main surface, and a second group of resonant lines (strip-line resonators) extending from a wide ground electrode of the portion of the side to the front main surface. Each of the resonant lines of the first group has a shorting end in the vicinity of the border between the back main surface and the side of the dielectric substrate. Each of the resonant lines of the second group has a shorting end in the vicinity of the border between the side and the front main surface of the dielectric substrate. The strip-line resonators of the first group and those of the second group have different resonant frequencies.

Japanese Unexamined Patent Application Publication No. 10-107537 discloses a method for manufacturing an antenna element to form a surface-mount antenna utilizing a strip-line resonator. The manufacturing method described in this patent document is a method for producing an antenna element by forming a circuit pattern on a dielectric base substrate, then dividing the dielectric base substrate into antenna-element bases, and forming an electrode on a side of each of the antenna-element bases.

In a filter element or an antenna element described in the above-described documents, resonant characteristics of a strip-line resonator are determined by the shape of a line (circuit pattern) provided on a main surface of a dielectric substrate (dielectric base substrate), and components that determine the resonant characteristics are concentrated on the main surface.

As a result, it is difficult to adjust the resonant characteristics after the circuit pattern is printed on the main surface of the dielectric substrate (dielectric base substrate). If the resonant characteristics of a strip-line resonator vary from a design value in a step of printing a circuit pattern, a subsequent step of dividing into element bases, or another step, a defective element having resonant characteristics different from the design value would be produced, thus causing a problem of decreasing manufacturability of elements.

SUMMARY OF THE INVENTION

In order to overcome the problems described above, preferred embodiments of the present invention provide a method for manufacturing a filter element, the method being capable of adjusting resonant characteristics of a strip-line resonator even after a circuit pattern is formed and also provide a filter element including a strip-line resonator whose resonant characteristics is adjusted using a configuration other than a circuit pattern formed on the front main surface.

A study conducted by the inventors revealed that the resonant characteristics of a strip-line resonator can be adjusted by setting the line width of a resonant line on a side (hereinafter this portion is referred to as a resonant-line side portion) and the line width of a resonant line on a front main surface (hereinafter this portion is referred to as a resonant-line main-surface portion) to different values and appropriately determining the line widths in a range at which the resonant-line side portion does not function as a ground electrode.

Specifically, by setting the line width of a resonant-line side portion slightly larger than the line width of a resonant-line main-surface portion, the resonant frequency of a corresponding strip-line resonator can be increased. By setting the line width of the resonant-line side portion smaller than the line width of the resonant-line main-surface portion, the resonant frequency of the strip-line resonator can be reduced. By setting a small spacing between resonant-line side portions of adjacent strip-line resonators, the degree of coupling between the strip-line resonators can be strengthened. By setting a large spacing between resonant-line side portions of adjacent strip-line resonators, the degree of coupling between the strip-line resonators can be weakened.

Preferred embodiments of the present invention are based on the foregoing findings and discoveries. A filter element according to a preferred embodiment of the present invention includes a flat dielectric substrate, a ground electrode on a back main surface of the dielectric substrate, resonant lines each having a shorting end in the vicinity of a border between a side and the back main surface of the dielectric substrate and extending from the side to a front main surface of the dielectric substrate, the ground electrode and the resonant lines constituting a plurality of strip-line resonators, and an input/output terminal coupled to any of the plurality of strip-line resonators. In any of the plurality of strip-line resonators, the line width of the resonant line on the front main surface is different from the line width of the resonant line of the strip-line resonator on the side.

As described above, the resonant line has a shorting end in the vicinity of the connection between the resonant line on the side (resonant-line side portion) and the ground electrode, and the resonant-line side portion and the resonant line on the front main surface (resonant-line main-surface portion) have different line widths. Therefore, a filter element can be formed that includes a strip-line resonator with adjusted resonant characteristics, that is, an adjusted resonant frequency.

The degree of coupling between two strip-line resonators whose resonant-line side portions are adjacent to each other can also be adjusted by setting the line width of the resonant-line side portion and the line width of the resonant-line main-surface portion to different values in at least one of the two strip-line resonators.

Among the plurality of strip-line resonators, a strip-line resonator coupled to the input/output terminal and a strip-line resonator adjacent thereto preferably are comb-line coupled to each other, and the other one or more strip-line resonators are interdigitally coupled to a strip-line resonator adjacent thereto.

According to this configuration, strong coupling by the interdigital coupling and wide-band characteristics are realized, and desired filter characteristics are achieved utilizing an attenuation pole at high frequencies peculiar to comb-line coupling.

The filter element preferably also further includes a comb-line coupling electrode that allows the two comb-line coupled strip-line resonators to be in conductive contact with each other and that is adjacent to the shorting ends in the strip-line resonators.

According to this configuration, in the case of a resonant mode in which two strip-line resonators have electric-field distributions in opposite phases and an electric wall is present in the center (odd mode), they resonate while being shorted by the comb-line coupling electrode. In the case of a resonant mode in which two strip-line resonators have electric-field distributions in phase and a magnetic wall is present in the center (even mode), they resonate while being opened at the comb-line coupling electrode portion. Therefore, the resonator length in the odd mode is smaller and the frequency is higher. Thus, the difference between the resonant frequencies in the odd and even modes is large, and strong comb-line coupling comparable to interdigital coupling is obtained.

As a result, significantly wide wide-band characteristics can be achieved even with the comb-line coupling.

The comb-line coupling electrode preferably includes an electrode on the front main surface of the dielectric substrate.

According to this configuration, even when the comb-line coupling electrode conducting the gap between the two comb-line coupled strip-line resonators is used, the degree of coupling between the two comb-line coupled resonators and the resonant frequency of each of the resonators can be adjusted.

The center of the resonant line on the side in the width direction and the center of the resonant line on the front main surface in the width direction preferably are not aligned with each other.

According to this configuration, any degree of coupling between adjacent strip-line resonators can be set.

In the filter element, the electrode thickness of the resonant line on the side preferably is larger than the electrode thickness of the resonant line on the front main surface.

According to this configuration, conductor losses at a shorting portion on which currents are concentrated in a strip-line resonator are reduced. As a result, the insertion loss of the filter element is small.

The resonant line on the front main surface preferably is composed of photosensitive conductive paste, and the resonant line on the side, the ground electrode, and the input/output terminal are composed of non-photosensitive conductive paste.

By formation of the front main surface from photosensitive conductive paste to, a fine-line circuit pattern (resonant line) can be formed by photolithography. In addition, the resonant line on the side, the ground electrode, and the input/output terminal can be manufactured in a simple process.

The line width of the at least one resonant line on the side surface having a line width less than the line width of the resonator lines on the front surface is preferably in a range of about 0.5 times to less than about 1 times the line width of the resonant lines on the front main surface and/or the line width of the at least one resonant line on the side surface having a line width greater than the line width of the resonator lines on the front surface is in a range of greater about 1 times to about 1.1 times the line width of the resonant lines on the front main surface.

Within the above-described ranges, a preferred embodiment of the present invention can provide reliable advantages, and the filter characteristics can be adjusted effectively by adjustment of the resonant frequency utilizing adjustment of the line width of the resonant line on the side of the dielectric substrate.

The front main surface of the dielectric substrate preferably is overlaid with an insulating layer, and the filter element preferably further includes an insulating-layer side electrode formed on a side of the insulating layer and extending from the resonant line on the side.

The insulating layer can prevent the side pattern from becoming shorted to an area to which the side pattern should not connect of the main-surface pattern. Therefore, the resonant line can be made merely by uniform formation of a side electrode on a side portion of both the insulating layer and the dielectric substrate uniformly. As a result, the manufacturing process can be simplified.

A method for manufacturing a filter element according to a preferred embodiment of the present invention preferably includes a dividing step of dividing a flat dielectric base substrate into a plurality of filter element bases, the dielectric base substrate including a front main surface on which a resonant-line main-surface portion is formed and a back main surface on which a ground electrode is formed and a resonant-line forming step of forming a resonant-line side portion on a side of each of the filter element bases produced in the dividing step from the resonant-line main-surface portion to the ground electrode using conductive paste through printing, drying, and firing in such a way that the resonant-line side portion has a line width that is different from the line width of the resonant-line main-surface portion and such that the resonant-line main-surface portion and the resonant-line side portion constitute a resonant line having a shorting end in the vicinity of a border between a side of the filter element base and the back main surface.

According to this manufacturing method, after the formation of the circuit pattern on the front main surface, the resonant characteristics of a strip-line resonator can be adjusted by adjustment of the line width of the side electrode to be formed on the side.

The resonant-line forming step preferably is a step of forming the resonant-line side portion on a filter element base extracted from the plurality of filter element bases produced in the dividing step, optimizing the shape of the resonant-line side portion, and then forming the resonant-line side portion having the optimized shape on all the plurality of filter element bases.

According to this manufacturing method, manufacturability of filter elements satisfying desired resonant characteristics can be enhanced.

Preferred embodiments of the present invention can adjust the resonant characteristics of a strip-line resonator by adjustment of a resonant line on a side of a dielectric substrate and can provide a filter element that realizes desired resonant characteristics. The method for manufacturing a filter element according to a preferred embodiment of the present invention enables adjustment of the characteristics of a strip-line resonator even after a circuit pattern or an insulating layer is formed on a main surface of a dielectric substrate and can significantly enhance manufacturability.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1A:
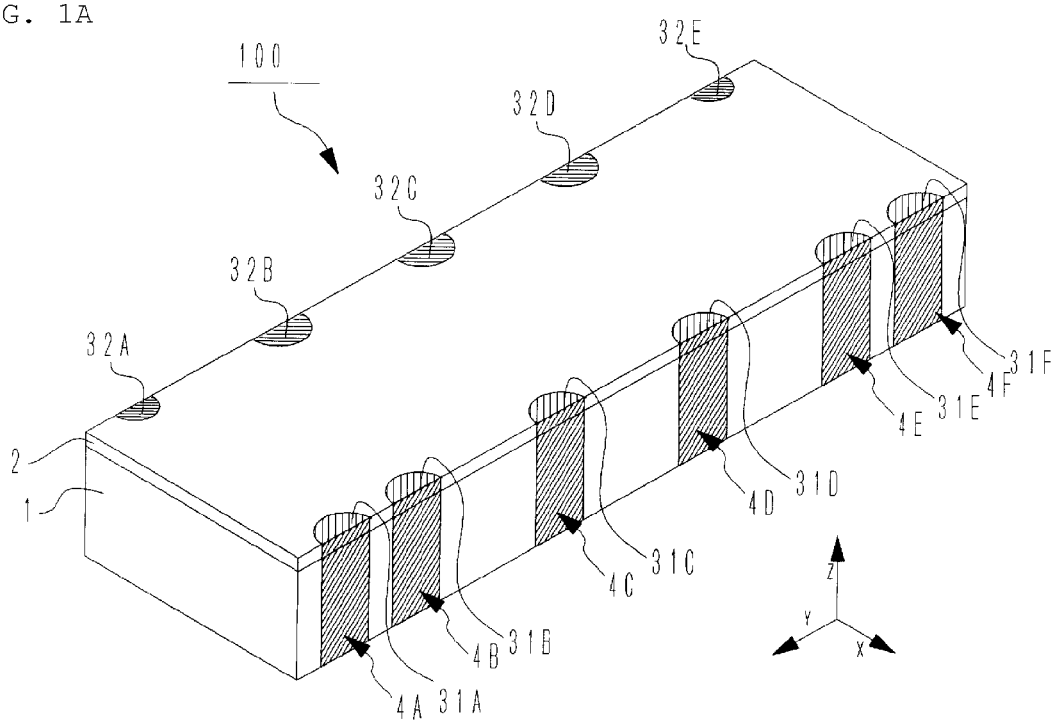
FIGS. 1A and 1B are perspective views that illustrate a configuration of a filter element according to a first preferred embodiment of the present invention.
Figure 1B:
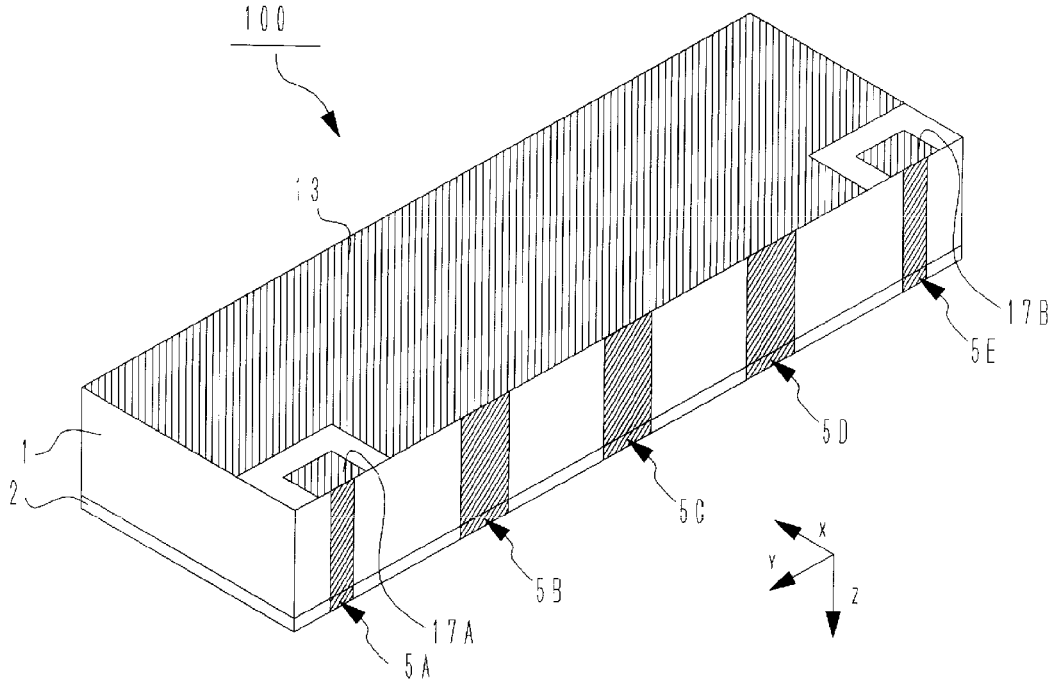
Figure 2:
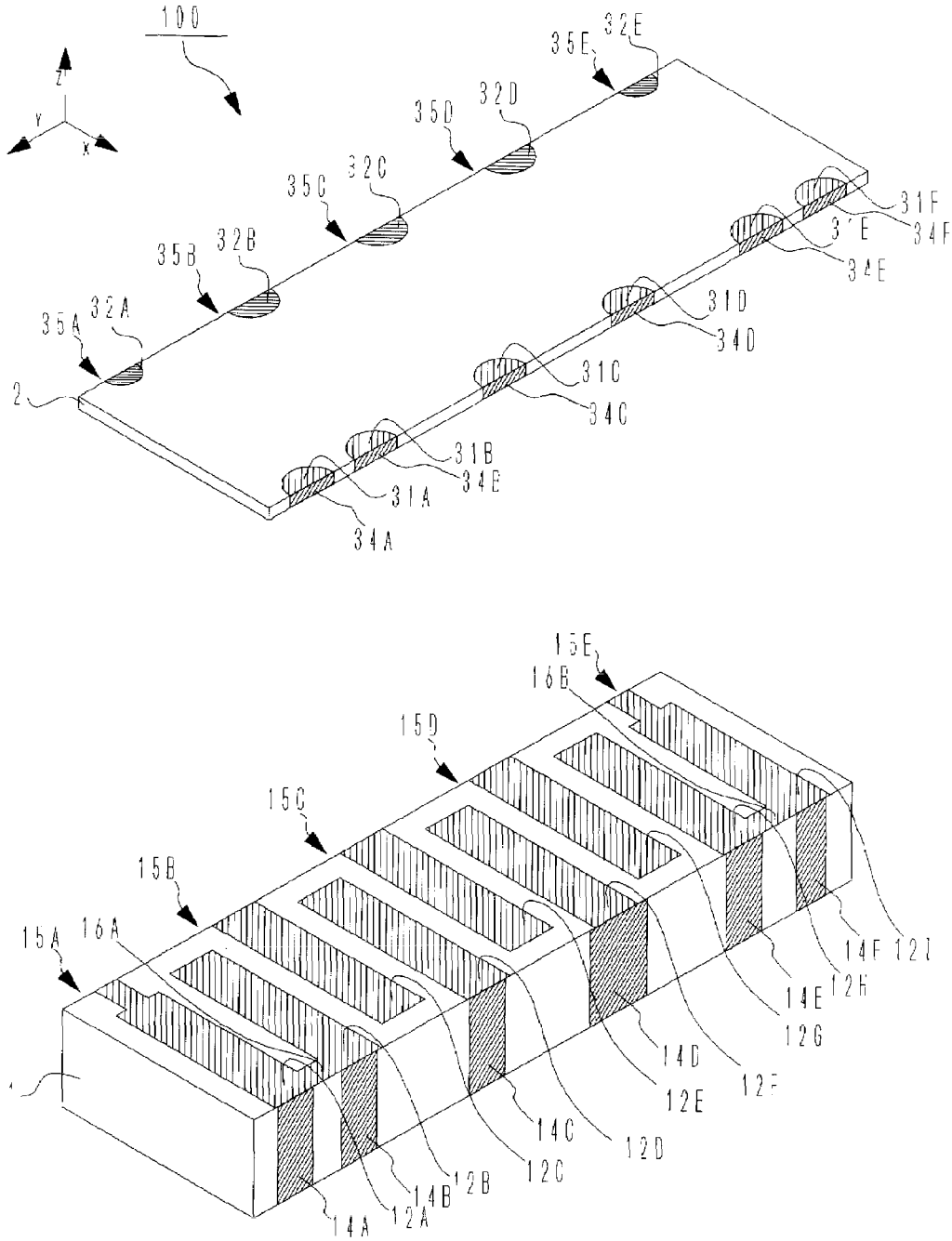
FIG. 2 is an exploded perspective view of the filter element according to the first preferred embodiment of the present invention.

A filter element according to a first preferred embodiment of the present invention will be described with reference to the drawings. The Cartesian coordinate system (X-Y-Z axes) shown in FIGS. 1A, 1B, and 2, is used in the following description. In the following description, every sequence of reference characters disclosed therein. e.g., "[p]rotruding electrodes 31A to 31F" are used to denote each reference character in the sequence, e.g., protruding electrodes 31A, 31B, 31C, 31D, 31E, and 31F. In the drawings, like reference numerals are used to denote the same or similar elements throughout the specification.

First, a general configuration of a filter element 100 according to the present preferred embodiment will be described. FIGS. 1A and 1B are external views of the filter element 100 according to the present preferred embodiment. FIG. 1A is a perspective view of the filter element 100 with the front (Y plane) being oriented to the left near side of the drawing. FIG. 1B is a perspective view that illustrates a state in which the filter element 100 shown in FIG. 1A is rotated 180° about the Y-axis.

The filter element 100 used for description in the present preferred embodiment is a filter element preferably having a substantially rectangular parallelepiped configuration. In the filter element 100, a front main surface of a dielectric substrate 1 is covered with a glass layer 2. A circuit pattern (not shown) for a strip-line resonator is formed on the front main surface of the dielectric substrate 1, i.e., between the dielectric substrate 1 and the glass layer 2 to form a filter. A configuration of the circuit pattern will be described later.

In the filter element 100, the substrate thickness of the dielectric substrate 1 (Z-axis dimension) preferably is about 500 μm, and the thickness of the glass layer 2 (Z-axis dimension) is about 15 μm to about 60 μm, for example. The outer dimensions of the filter element 100 preferably are an X-axis dimension of approximately 9.5 mm and a Y-axis dimension of approximately 2.2 mm, for example. The filter element 100 is a small filter element that has wide-band filter characteristics for use in ultra wide band (UWB) communications.

The dielectric substrate 1 is a substrate made of a ceramic dielectric, such as titanium oxide, and having a relative dielectric constant of approximately 110. The glass layer 2 is made of an insulator, such as crystalline silicon oxide and borosilicate glass, and has a structure in which a light-transmitting glass layer and a light-shielding glass layer are laminated (not shown).

The light-transmitting glass layer is in contact with the dielectric substrate 1. The light-transmitting glass layer exerts high adhesion strength to the dielectric substrate 1, prevents removal of a circuit pattern on the dielectric substrate 1, and enhances environmental resistance of the circuit pattern and the filter element 100. Here, the light-transmitting glass layer has a coefficient of linear expansion substantially the same as a coefficient of linear expansion of the dielectric of the dielectric substrate 1. This is realized by adjustment of the composition of the light-transmitting glass layer. This enables small thermal stress occurring between the dielectric substrate 1 and the glass layer 2.

The light-shielding glass layer is made of glass that contains inorganic pigment placed on the top of the light-transmitting glass layer. The light-shielding glass layer enables printing onto the surface of the filter element and ensures the confidentiality of the internal circuit pattern.

Of course, it will be understood that the two-layer structure of the glass layer 2 is not indispensable, that is, the glass layer 2 may have a single-layer structure. In this case, whether the single layer is made of light-shielding glass or light-transmitting glass can be determined depending on the priorities of the adhesion strength, the confidentiality, and printing features.

The composition and dimensions of each of the dielectric substrate 1 and the glass layer 2 can be set in consideration of the degree of adhesion between the dielectric substrate and the glass layer, the environmental resistance, the filter characteristics, or other factors.

Protruding electrodes 31A to 31F and 32A to 32E are disposed on the front main surface of the glass layer 2 as shown in FIG. 1A. The protruding electrodes 31A to 31F and 32A to 32E are electrodes that protrude from side electrodes, which will be described later, to the main surface when the side electrodes are printed. Depending on printing conditions, no protruding electrodes may be produced. Electrodes also protrude to the back main surface of the filter element 100 when the side electrodes are printed. The electrodes protruding to the back main surface become integrated with a ground electrode 13 and terminal electrodes 17A and 17B as shown in FIG. 1B.

Because the front main surface of the dielectric substrate 1 is overlaid with the glass layer 2, the protruding electrodes adjacent to the front main surface can be prevented from becoming shorted to an area to which the side pattern should not be connected of the pattern on the main surface when the side electrodes are printed. Environmental resistance to physical factors from the outside and thermal factors in use is also enhanced.

The ground electrode 13 and the terminal electrodes 17A and 17B are disposed on the back main surface of the dielectric substrate 1. The ground electrode 13 is an electrode of a strip-line resonator and also serves as a ground electrode for implementing the filter element 100 on an implementation substrate. The terminal electrodes 17A and 17B are connected to a radio-frequency signal input/output terminal when the filter element 100 is implemented on the implementation substrate. The ground electrode 13 is disposed on substantially all the back main surface of the dielectric substrate 1. The terminal electrodes 17A and 17B are disposed in the vicinity of respective corners in contact with the left side and separated from the ground electrode 13. Each of the ground electrode 13 and the terminal electrodes 17A and 17B is an electrode that is formed by printing, such as screen printing, using conductive paste and firing and that has a thickness (in the Z-axis direction) of approximately 15 μm, for example.

Side electrodes 4A to 4F and side electrodes 5A to 5E are disposed on the right side and the left side of the filter element 100, respectively. Each of the side electrodes 4A, 4B, 4C, 4D and 4F (FIG. 1A) and 5A, 5B, 5C, 5D and 5E (FIG. 1B) includes a resonant-line side portion and an insulating-layer side electrode. Each of the side electrodes 4A to 4F and 5A to 5E is an electrode that preferably have a substantially rectangular shape, extends in the Z-axis direction from the back main surface of the dielectric substrate 1 to the front main surface of the glass layer 2, is made of silver, is formed by printing, such as screen printing, using conductive paste and firing, has a thickness (X-axis dimension) of approximately 15 μm, and has a line width different from the line width of the interlayer circuit pattern (not shown) disposed between the dielectric substrate 1 and the glass layer 2. The line widths of the side electrodes 4A to 4F and 5A to 5E will be described later.

The side electrodes 4A to 4F are in conductive contact with the interlayer circuit pattern (not shown) disposed between the dielectric substrate 1 and the glass layer 2 and with the ground electrode 13, and in conductive contact with the protruding electrodes 31A to 31F, respectively. The side electrodes 5B to 5D are in conductive contact with the interlayer circuit pattern (not shown) disposed between the dielectric substrate 1 and the glass layer 2 and with the ground electrode 13, and in conductive contact with the protruding electrodes 32B to 32D, respectively. The side electrodes 5A and 5E are in conductive contact with the interlayer circuit pattern (not shown) disposed between the dielectric substrate 1 and the glass layer 2, and in conductive contact with the protruding electrodes 32A and 32E, respectively, and with the terminal electrodes 17A and 17B, respectively.

An internal configuration of the filter element 100 will now be described. FIG. 2 is an exploded perspective view of the filter element 100 and illustrates a state in which the dielectric substrate 1 and the glass layer 2 are separated from each other.

Resonant-line side portions 14A to 14F are disposed on the right side of the dielectric substrate 1. Side terminal electrodes 15A and 15E and resonant-line side portions 15B to 15D are disposed on the left side of the dielectric substrate 1.

Resonant-line main-surface portions 12A to 12I and comb-line coupling electrodes 16A and 16B are disposed on the front main surface of the dielectric substrate 1. Each of the resonant-line main-surface portions 12A to 12I and the comb-line coupling electrodes 16A and 16B preferably is a silver electrode that has an electrode thickness (Z-axis dimension) of approximately 6 μm and is formed by, for example, photolithography using photosensitive silver paste, for example.

In contrast to the resonant-line main-surface portions 12A to 12I and the comb-line coupling electrodes 16A and 16B having an electrode thickness (Z-axis dimension) of approximately 6 μm, the above-described side electrodes 4A to 4F and 5A to 5E as shown in FIGS. 1A and 1B, respectively have an electrode thickness of approximately 15 μm, that is, the electrode thickness of the side electrodes 4A to 4F and 5A to 5E is larger. This aims to distribute current and reduce conductor loss by increasing the electrode thickness of a shorting-end portion, where current is concentrated in general, of a resonant line. According to this configuration, the filter element 100 is an element that has a small insertion loss.

Each of the resonant-line main-surface portions 12A and 12B is an electrode preferably having a substantially rectangular shape. The resonant-line main-surface portions 12A and 12B are continuous with the resonant-line side portions 14A and 14B, respectively, on the right side of the dielectric substrate 1. The resonant-line main-surface portion 12A is continuous with the side terminal electrode 15A at an area adjacent to the left side of the front main surface and is in conductive contact with the terminal electrode 17A via the side terminal electrode 15A. The resonant-line main-surface portion 12A and the resonant-line side portion 14A constitute a resonant line, and the resonant-line main-surface portion 12B and the resonant-line side portion 14B constitute a resonant line. Together with the ground electrode 13 (FIG. 1B), each of the resonant lines constitutes a strip-line resonator. The comb-line coupling electrode 16A is disposed between the resonant-line main-surface portions 12A and 12B and connects them at an area adjacent to the right side of the front main surface.

Accordingly, two strip-line resonators that are comprised of one including the resonant-line main-surface portion 12A and the other including the resonant-line main-surface portion 12B are comb-line coupled to each other. Resonant modes occurring between the two strip-line resonators are an odd mode in which an electrical wall is present in the center between the resonant lines and an even mode in which a magnetic wall is present in the center between the resonant lines. In the case of the odd mode, the two strip-line resonators are shorted by the comb-line coupling electrode 16A. In the case of the even mode, the two strip-line resonators are opened at the comb-line coupling electrode 16A portion. As a result, the resonator length is smaller and the frequency is higher in the odd mode than those in the even mode. Therefore, the difference between the resonant frequencies in the odd mode and even mode is large, and strong comb-line coupling comparable to interdigital coupling is obtainable.

Each of the resonant-line main-surface portions 12H and 12I is an electrode preferably having a substantially rectangular shape. The resonant-line main-surface portions 12H and 12I are continuous with the resonant-line side portions 14E and 14F, respectively, on the right side of the dielectric substrate 1. The resonant-line main-surface portion 12I is continuous with the side terminal electrode 15E at an area adjacent to the right side of the front main surface and is in conductive contact with the terminal electrode 17B via the side terminal electrode 15E. The resonant-line main-surface portion 12H and the resonant-line side portion 14E constitute a resonant line, and the resonant-line main-surface portion 12I and the resonant-line side portion 14F constitute a resonant line. Together with the ground electrode 13, each of the resonant lines constitutes a strip-line resonator. The comb-line coupling electrode 16B is disposed between the resonant-line main-surface portions 12H and 12I and connects them at an area adjacent to the right side of the front main surface. Accordingly, as in the case of an electrode constituted by the resonant-line main-surface portions 12A and 12B and the comb-line coupling electrode 16A, strong comb-line coupling comparable to interdigital coupling is also obtainable between a strip-line resonator including the resonant-line main-surface portion 12H and a strip-line resonator including the resonant-line main-surface portion 12I.

Each of the resonant-line main-surface portions 12C to 12G is a silver electrode preferably having a substantially rectangular shape. The resonant-line main-surface portions 12C, 12E, and 12G are continuous with the resonant-line side portions 15B, 15C, and 15D, respectively, on the left side of the dielectric substrate 1 and are opened at an area adjacent to the right side. The resonant-line main-surface portions 12D and 12F are continuous with the resonant-line side portions 14C and 14D, respectively, on the right side of the dielectric substrate 1 and are opened at an area adjacent to the left side. Each of the resonant-line main-surface portions 12C to 12G constitutes a resonant line, together with the resonant-line side portions 15B, 14C, 15C, 14D, and 15D, respectively. Each of the resonant lines constitutes a strip-line resonator, together with the ground electrode 13 (FIG. 1B). Here, the strip-line resonators are arranged so as to have alternating orientations of the open ends and the shorting ends. Thus, these strip-line resonators are interdigitally coupled to each other.

The line width (Y-axis dimension) of each of the resonant lines constituting the resonant-line main-surface portions 12A to 12I and spacing between the resonant lines are adjusted to realize necessary frequency characteristics. Here, the resonant-line main-surface portions 12A to 12I have the same line width and constant spacing. Of course, it will be understood that the present invention is not limited to the foregoing configuration (line width and spacing).

By the provision of the resonant-line main-surface portions 12A to 12I having such a configuration, a strip-line resonator that includes the resonant-line main-surface portion 12A is tapped to the terminal electrode 17A (FIG. 1B). Two strip-line resonators, one including the resonant-line main-surface portion 12A and the other including the resonant-line main-surface portion 12B, are comb-line coupled to each other. The strip-line resonator including the resonant-line main-surface portion 12B is interdigitally coupled to a strip-line resonator that includes the resonant-line main-surface portion 12C. The strip-line resonator including the resonant-line main-surface portion 12C is interdigitally coupled to a strip-line resonator that includes the resonant-line main-surface portion 12D. The strip-line resonator including the resonant-line main-surface portion 12D is interdigitally coupled to a strip-line resonator that includes the resonant-line main-surface portion 12E. The strip-line resonator including the resonant-line main-surface portion 12E is interdigitally coupled to a strip-line resonator that includes the resonant-line main-surface portion 12F. The strip-line resonator including the resonant-line main-surface portion 12F is interdigitally coupled to a strip-line resonator that includes the resonant-line main-surface portion 12G. The strip-line resonator including the resonant-line main-surface portion 12G is interdigitally coupled to a strip-line resonator that includes the resonant-line main-surface portion 12H. Two strip-line resonators, one including the resonant-line main-surface portion 12H and the other including the resonant-line main-surface portion 12I, are comb-line coupled to each other. The strip-line resonator including the resonant-line main-surface portion 12I is tapped to the terminal electrode 17B.

Accordingly, the chip filter element serves as a band-pass filter that has a nine-stage resonator. The filter element realizes wide-band characteristics using strong coupling achieved by interdigital coupling and obtains desired filter characteristics utilizing an attenuation pole at high frequencies peculiar to comb-line coupling.

The glass layer 2 is a glass layer formed by, for example, screen printing, using glass paste and firing. Insulating-layer side electrodes 34A to 34F included in the side electrodes 14A to 14F respectively, are disposed on the right side of the glass layer 2. Insulating-layer side electrodes 35A to 35E included in the side electrodes 15A to 15E, respectively, are disposed on the left side of the glass layer 2. The protruding electrodes 31A to 31F and 32A to 32E are present on the front main surface of the glass layer 2.

Because the dielectric substrate 1 and the glass layer 2 are stacked and the glass layer 2 is arranged so as to cover the resonant-line main-surface portions 12A to 12I, as described above, the environmental resistance of the filter element 100 to, for example, humidity, temperature, and physical damage is enhanced.

An example configuration of the spacing and line width of the resonant-line side portions 14A to 14F will now be described with reference to FIG. 3.

The resonant-line side portion 14A is arranged at a position that is continuous with the resonant-line main-surface portion 12A and has a line width smaller than that of the resonant-line main-surface portion 12A. The line widths of the resonant-line side portions 14B, 14C, 14E, and 14F are smaller than the line widths of the resonant-line main-surface portions 12B, 12D, 12H, and 12I, which are continuous therewith, respectively. When the line width of a resonant-line side portion is smaller than the line width of a resonant-line main-surface portion, as described above, it is preferable that the line width of the resonant-line side portion be smaller than the line width of the resonant-line main-surface portion and larger than about 0.5 times thereof. Within such a range, changes in the resonant frequency caused by setting the line width of a resonant line on a side of the dielectric substrate are outstanding.

Setting the line width of the resonant-line side portion smaller than the line width of the resonant-line main-surface portion, as described above, enables the resonant frequency of the strip-line resonator to be smaller than that when the resonant-line side portion and the resonant-line main-surface portion have the same line width.

The resonant-line side portion 14D is arranged at a position continuous with the resonant-line main-surface portion 12F and has a line width larger than that of the resonant-line main-surface portion 12F. When the line width of a resonant-line side portion is larger than the line width of a resonant-line main-surface portion, as described above, it is preferable that the line width of the resonant-line side portion be larger than the line width of the resonant-line main-surface portion and smaller than about 1.1 times the line width of the resonant-line main-surface portion. Within such a range, by setting the line width of a resonant line on a side of the dielectric substrate, the adjustment of the filter characteristics realized by adjustment of the resonant frequency can be performed effectively.

When the line width of a resonant-line side portion is slightly larger than the line width of a resonant-line main-surface portion, the resonant frequency can be larger than that when the resonant-line side portion and the resonant-line main-surface portion have the same line width.

The strength of comb-line coupling varies according to the distance between the resonant-line side portions 14A and 14B. When the distance between the resonant-line side portions is reduced, the degree of coupling between strip-line resonators including them can be enhanced. When the distance between the resonant-line side portions is increased, the degree of coupling between strip-line resonators including them can be weakened.

In this example configuration, the line width of each of the resonant-line side portions 14A and 14B is reduced, which means that the distance between these resonant-line side portions is increased. As a result, the effects of weakening the comb-line coupling are produced. However, the effects of enhancing the comb-line coupling caused by the comb-line coupling electrode are larger. Therefore, strong comb-line coupling is obtained here.

The comb-line coupling can be set such that the center of a resonant-line side portion in the width direction and the center of a corresponding resonant-line main-surface portion in the width direction are not aligned with each other. As illustrated in the drawing, the center of the resonant-line side portion 14B and the center of the resonant-line main-surface portion 12B in the width direction are not aligned with each other in such a way that the resonant-line side portion 14B is near the resonant-line side portion 14A. In this way, the degree of comb-line coupling is enhanced.

Figure 3:
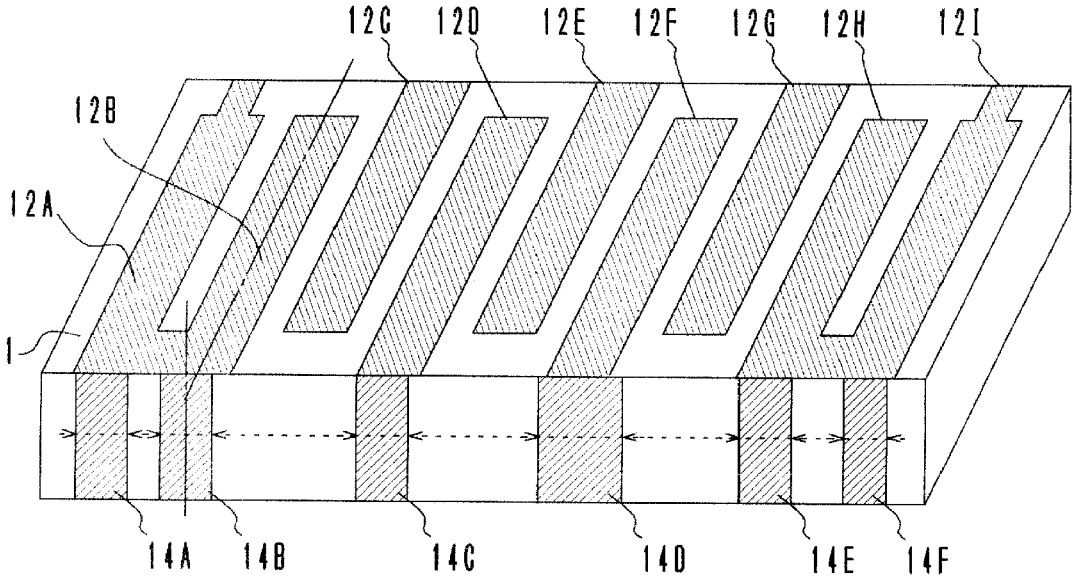
FIG. 3 is a perspective view of a dielectric substrate according to the first preferred embodiment of the present invention.

As for the resonant-line side portions 14C and 14D shown in FIG. 3, by adjustment of the line width of a resonant-line side portion on a side of the dielectric substrate, the resonant frequency of each of the resonators can be adjusted.

According to the above-described arrangement configuration of the resonant-line side portions 14A and 14B, the comb-line coupling electrode 16A (FIG. 2) conducting the gap between the two comb-line coupled strip-line resonators can be provided, and the degree of coupling between the two comb-line coupled resonators and the resonant frequency of each of the resonators can also be adjusted by adjustment of the line widths of the resonant-line side portions and the spacing thereof. The same applies to an arrangement configuration of the resonant-line side portions 14E and 14F.

As described above, providing a resonant line that has a shorting end in the vicinity of a connection between a resonant-line side portion and a ground electrode and setting the line width of the resonant-line side portion and the line width of a resonant-line main-surface portion to different values enables a filter element with adjusted resonant characteristics of a strip-line resonator, that is, an adjusted resonant frequency, and an adjusted degree of coupling to an adjacent strip-line resonator.

The effects contributing to a change in the resonant frequency resulting from the line width of a resonant-line side portion are smaller than those resulting from the line width of a resonant-line main-surface portion. Accordingly, the adjustment of the line width of the resonant-line side portion enables adjustment of the resonant frequency of the filter element with high precision.

A process for manufacturing the filter element 100 will now be described.

Figure 4:
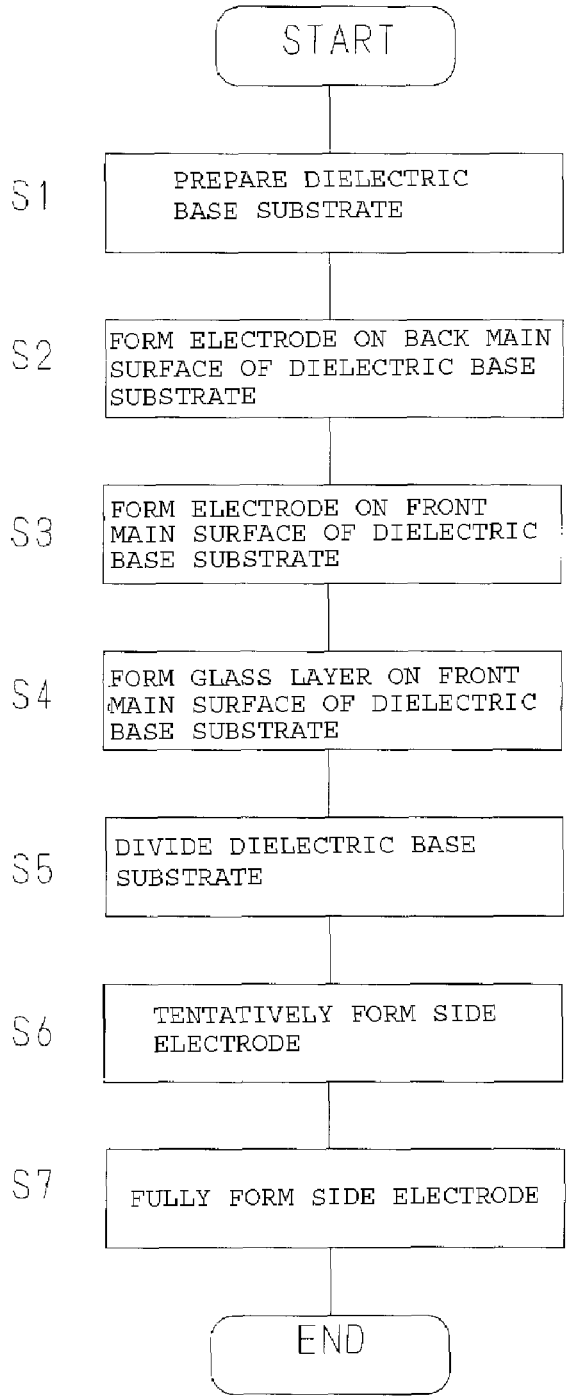
FIG. 4 is an illustration for describing steps for manufacturing the filter element according to the first preferred embodiment of the present invention.

At the START of a process for manufacturing the filter element 100 illustrated in FIG. 4, first, in S1, a dielectric base substrate on which no electrode has been formed yet on any surface is prepared.

In S2, conductive paste is applied on the back main surface of the dielectric base substrate by screen printing, and through firing, a ground electrode and a terminal electrode are formed.

In S3, a pattern using photosensitive conductive paste is formed on the front main surface of the dielectric base substrate through printing, exposure, and development, using photolithography, and, through firing, various electrodes (circuit pattern) are formed thereon.

In S4, glass paste is applied on the front main surface of the dielectric base substrate by printing, and through firing, a glass layer is formed.

In S5, a large number of filter element bases are cut from the dielectric base substrate formed in the above-described manner by, for example, dicing. After cutting, electrical characteristics of the patterns on the upper surface of a portion of the filter element bases are preliminarily measured.

In S6, one or a few filter element bases are extracted from the cut filter element bases, side electrodes are tentatively formed thereon, and an optimized side electrode pattern that has a line width of each of the side electrodes and spacing of the side electrodes for realizing desired resonant characteristics is selected.

In S7, after the optimized side pattern having the line width and spacing realizing desired resonant characteristics is selected through tentative formation of side electrodes on the extracted filter element bases, conductive paste is applied on a plurality of filter element bases on the same substrate lot to form the optimized pattern by printing, and through firing, side electrodes are formed, and the process for manufacturing the filter element 100 is concluded at the END.

The above-described manufacturing method enables adjustment of resonant characteristics of a strip-line resonator by formation of a resonant-line side portion on a side after formation of a circuit pattern on the front main surface. Therefore, desired resonant characteristics can be reliably obtained.

When the line width of a side electrode is larger than the line width of a main-surface electrode, if a print position is misaligned during printing of the side electrode, the width of a connection portion of the side electrode and the main-surface electrode tends to change. This change in width may cause a change in resonant frequency. Therefore, it is preferable that the line width of the side electrode be smaller than the line width of the main-surface electrode. When the line width of the side electrode is smaller than the line width of the main-surface electrode, as described above, the resonant line has a step impedance structure. In this case, it is easy to have the resonant frequency even if the line length of the main-surface electrode is reduced. This contributes to miniaturization of the filter. When the line width of the side electrode is smaller than the line width of the main-surface electrode, the degree of flexibility in adjustment of spacing of adjacent side electrodes is increased. This contributes to facilitation of adjustment of the degree of coupling thereof.

Figure 5A:
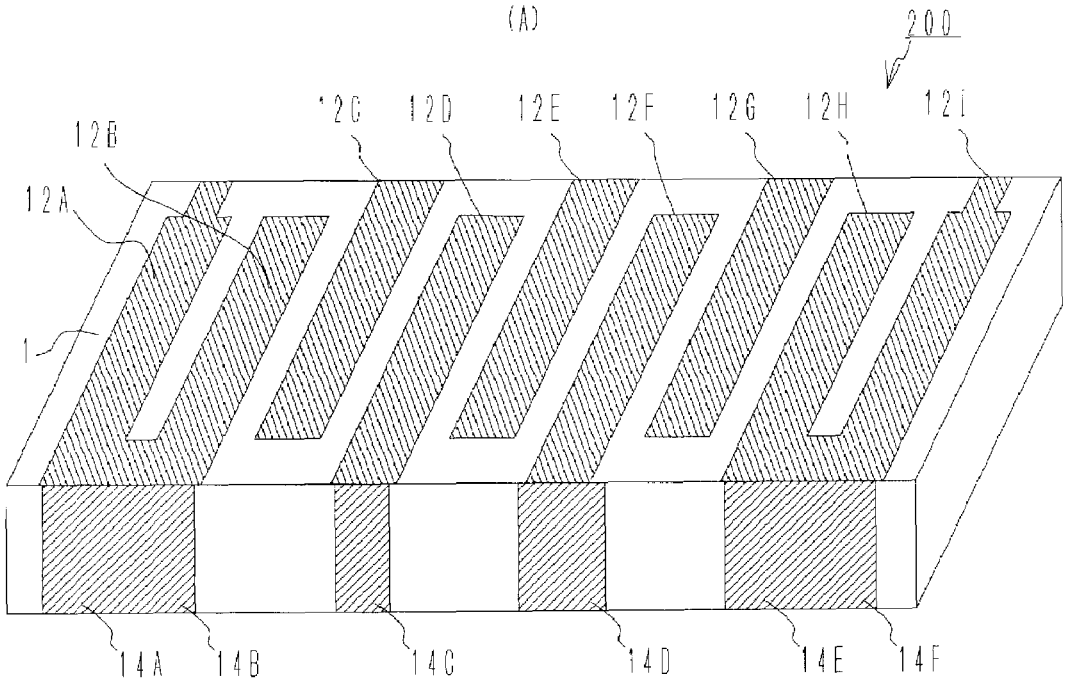
FIGS. 5A and 5B are illustrations for describing a filter element according to another preferred embodiment of the present invention.

A filter element according to a second preferred embodiment will now be described based on FIG. 5A.

A filter element 200 according to the present preferred embodiment differs from the filter element 100 (FIGS. 1A, 1B, and 2) in that a resonant-line side portion on a side of the dielectric substrate 1 has a different shape. Specifically, resonant-line side portions for two comb-line coupled strip-line resonators have a wide common portion disposed therebetween. This further enhances comb-line coupling, compared with the filter element 100 according to the first preferred embodiment. Even in this case, by adjustment of the line width of the common resonant-line side portion and the amount of displacement, the resonant frequency and the degree of coupling can be adjusted to some extent.

Figure 5B:
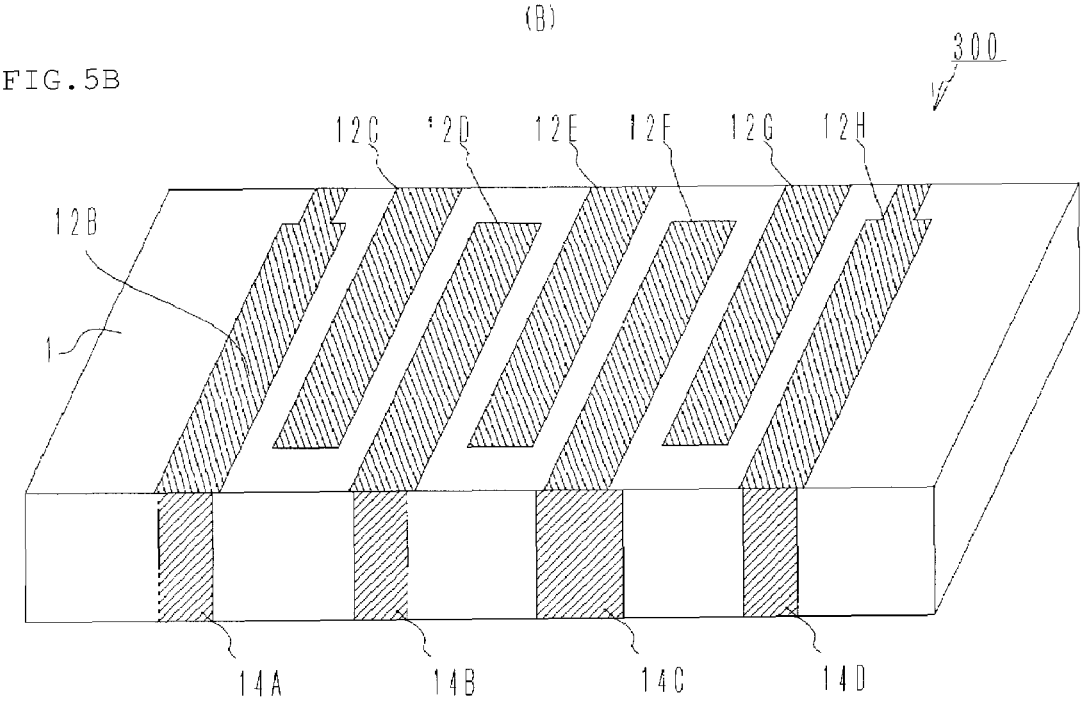

A filter element according to a third preferred embodiment will now be described based on FIG. 5B.

A filter element 300 according to the present preferred embodiment uses only interdigital coupling without using comb-line coupling, as coupling between strip-line resonators. The present invention is suitably applicable to such a filter.

The arrangement and configuration of resonant-line main-surface portions and resonant-line side portions described above are made based on product specifications and can have any form. The number of resonator stages is not limited to the above-described number. The present invention is also applicable to configurations other than the above-described configuration. The present invention is applicable to various shapes of circuit patterns as long as a resonant line has a shorting end in vicinity of a connection between a resonant-line side portion of a strip-line resonator and a ground electrode.

The present invention is applicable to a circuit pattern composed of strip lines having various configurations.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A filter element comprising:

a flat dielectric substrate;

a ground electrode on a back main surface of the dielectric substrate;

resonant lines each having a shorting end located in an area of a border between a side surface and the back main surface of the dielectric substrate and extending from the side surface to a front main surface of the dielectric substrate, wherein the ground electrode and the resonant lines constitute a plurality of strip-line resonators; and an input/output terminal coupled to any of the plurality of strip-line resonators; wherein in any of the plurality of strip-line resonators, a line width of substantially the entire portion of the resonant line on the front main surface is different from a line width of the resonant line of the strip-line resonator on the side surface; and the line width of at least one of the resonant lines on the side surface is less than the line width of the resonator lines on the front surface, and the line width of at least another one of the resonator lines on the side surface is greater than the line width of the resonator lines on the on the front surface.

2. The filter element according to claim 1, wherein, among the plurality of strip-line resonators, a strip-line resonator coupled to the input/output terminal and a strip-line resonator adjacent thereto are comb-line coupled to each other, and at least another one of the strip-line resonators is interdigitally coupled to a strip-line resonator adjacent thereto.

3. The filter element according to claim 2, further comprising a comb-line coupling electrode that allows the comb-line coupled strip-line resonators to be in conductive contact with each other and that is adjacent to the shorting ends in the strip-line resonators.

4. The filter element according to claim 3, wherein the comb-line coupling electrode comprises an electrode on the front main surface of the dielectric substrate.

5. The filter element according to claim 1, wherein the center of the resonant line on the side surface in the width direction and the center of the resonant line on the front main surface in the width direction are not aligned with each other.

6. The filter element according to claim 1, wherein the electrode thickness of the resonant line on the side is larger than the electrode thickness of the resonant line on the front main surface.

7. The filter element according to claim 1, wherein the resonant line on the front main surface is composed of photosensitive conductive paste, and the resonant line on the side, the ground electrode, and the input/output terminal are composed of non-photosensitive conductive paste.

8. The filter element according to claim 1, wherein the line width of the at least one resonant line on the side surface having a line width less than the line width of the resonator lines on the front surface is in a range of about 0.5 times to less than about 1 times the line width of the resonant lines on the front main surface and the line width of at least another resonant line on the side surface having a line width greater than the line width of the resonator lines on the front surface is in a range of greater than about 1 times to about 1.1 times the line width of the resonant lines on the front main surface.

9. The filter element according to claim 1, wherein the front main surface of the dielectric substrate is overlaid with an insulating layer, and further comprising an insulating-layer side electrode disposed on a side of the insulating layer and extending from the resonant line on the side.

10. A method for manufacturing a filter element, the method comprising:

a dividing step of dividing a flat dielectric base substrate into a plurality of filter element bases, the dielectric base substrate including a front main surface on which resonant-line main-surface portions are formed and a back main surface on which a ground electrode is formed; and a resonant-line forming step of forming resonant-line side portions on a side of each of the filter element bases produced in the dividing step from the resonant-line main-surface portions to the ground electrode using conductive paste through printing, drying, and firing such that substantially the entire resonant-line main-surface portions have a line width different from a line width of the resonant-line side portions and such that the resonant-line main-surface portions and the resonant-line side portions constitute resonant lines having a shorting end in an area of a border between a side of the filter element base and the back main surface; wherein the line width of at least one of the resonant-line side portions is less than the line width of the resonant-line main-surface portions, and the line width of at least another one of the resonant-line side portions is greater than the line width of the resonant-line main-surface portions.

11. The method for manufacturing a filter element according to claim 10, wherein the resonant-line forming step is a step of forming the resonant-line side portions on a filter element base extracted from the plurality of filter element bases produced in the dividing step, optimizing the shape of the resonant-line side portions, and then forming the resonant-line side portions having the optimized shape on all the plurality of filter element bases.

* * * * *